US012317941B2

(12) United States Patent
Sankar

(10) Patent No.: US 12,317,941 B2
(45) Date of Patent: Jun. 3, 2025

(54) MULTI-USE ARTICLE

(71) Applicant: Ashley Sankar, Phoenix, AZ (US)

(72) Inventor: Ashley Sankar, Phoenix, AZ (US)

( * ) Notice: Subject to any disclaimer, the term of this patent is extended or adjusted under 35 U.S.C. 154(b) by 0 days.

(21) Appl. No.: 18/482,862

(22) Filed: Oct. 7, 2023

(65) Prior Publication Data

US 2024/0081445 A1 Mar. 14, 2024

Related U.S. Application Data

(63) Continuation of application No. 17/931,400, filed on Sep. 12, 2022, now Pat. No. 11,779,067.

(51) Int. Cl.

| | |
|---|---|
| ***A41D 15/04*** | (2006.01) |
| ***A41D 3/02*** | (2006.01) |
| ***A41D 15/00*** | (2006.01) |
| ***A45F 4/12*** | (2006.01) |

(52) U.S. Cl.

CPC ..... *A41D 15/04* (2013.01); *A41D 3/02* (2013.01); *A41D 15/002* (2013.01); *A45F 4/12* (2013.01); *A41D 2300/322* (2013.01)

(58) Field of Classification Search

CPC ..... A41D 15/002; A41D 15/04; A41D 1/02; A41D 3/02; A41D 2300/322; A45F 4/12

USPC ..... 2/95, 96, 108

See application file for complete search history.

(56) References Cited

U.S. PATENT DOCUMENTS

| | | | |
|---|---|---|---|
| 3,797,043 | A | 3/1974 | Brument |
| 4,103,377 | A | 8/1978 | Mayer et al. |
| 4,227,264 | A | 10/1980 | Spector et al. |
| 5,850,634 | A | 12/1998 | Toombs |
| 5,860,164 | A | 1/1999 | Johnson |
| 6,061,831 | A | 5/2000 | Rudolph et al. |
| 7,165,271 | B2 | 1/2007 | Elen |
| 9,185,940 | B2 | 11/2015 | Sparks |
| D751,288 | S | 3/2016 | Majmundar |
| 9,554,601 | B2 | 1/2017 | Arajakis |
| 9,615,610 | B2 | 4/2017 | Biller |
| 9,723,882 | B2 | 8/2017 | Reuben |
| 9,788,584 | B2 | 10/2017 | Koo |
| 9,907,344 | B2 | 3/2018 | Poore et al. |
| 9,986,774 | B2 | 6/2018 | Puente et al. |
| 10,051,901 | B2 | 8/2018 | Peyser |

(Continued)

FOREIGN PATENT DOCUMENTS

| | | |
|---|---|---|
| EP | 0111634 | 6/1984 |
| FR | 2747894 | 10/1997 |

*Primary Examiner* — Gloria M Hale

(74) *Attorney, Agent, or Firm* — Johnfar Kerlee

(57) ABSTRACT

Disclosed are embodiments of a multi-use article that can function as a jacket, carrying bag, blanket and/or pillow. In one embodiment, a multi-use article includes a first portion (torso cover) and a second portion (leg cover) releasably coupled by a fastener. The leg cover can include another fastener along axial edges of the leg cover to releasably couple its axial edges and form an enclosure. The leg cover can include a third fastener along a distal edge of the leg cover to provide the bottom of a bag when the third fastener is closed. When released from the leg cover, the torso cover can be used as a jacket, for example. When released from the torso cover, the leg cover can be configured as a blanket, carrying bag, and/or pillow (or pillow case). The torso cover can be inserted into a suitably configured leg cover to form a pillow.

9 Claims, 4 Drawing Sheets

(56) References Cited

U.S. PATENT DOCUMENTS

| | | | | |
|---|---|---|---|---|
| 10,455,873 | B2 | 10/2019 | Feterman | |
| 10,602,783 | B1 | 3/2020 | Colligan et al. | |
| 10,772,366 | B1 | 9/2020 | Ngan | |
| 10,874,199 | B2 | 12/2020 | James et al. | |
| 10,945,472 | B2 | 3/2021 | Macrae | |
| 10,945,519 | B2 | 3/2021 | Chacker | |
| 10,973,309 | B2 | 4/2021 | Thomas | |
| 11,083,278 | B2 | 8/2021 | Villaruz | |
| 11,229,247 | B2 | 1/2022 | Tirro et al. | |
| 11,337,471 | B2 | 5/2022 | Schwirtz et al. | |
| 11,470,894 | B1 * | 10/2022 | Sankar | A41D 3/005 |
| 11,779,067 | B1 * | 10/2023 | Sankar | A41D 15/002 2/69.5 |
| 2002/0088048 | A1 | 7/2002 | Turner | |
| 2008/0235848 | A1 | 10/2008 | Wilder et al. | |
| 2008/0235849 | A1 | 10/2008 | McCray-Clark | |
| 2009/0031477 | A1 | 2/2009 | Olmos Plaza | |
| 2010/0111448 | A1 | 5/2010 | Li | |
| 2010/0127025 | A1 | 5/2010 | Kelling | |
| 2011/0179559 | A1 | 7/2011 | Smoot et al. | |
| 2012/0237700 | A1 | 9/2012 | Komatsu | |
| 2014/0137308 | A1 | 5/2014 | Koo | |
| 2014/0366239 | A1 * | 12/2014 | Biller | A41D 15/00 2/69.5 |
| 2016/0066632 | A1 | 3/2016 | Puente et al. | |
| 2016/0157535 | A1 | 6/2016 | Tirro et al. | |
| 2016/0165975 | A1 * | 6/2016 | Reuben | A41D 15/04 2/69.5 |
| 2016/0353816 | A1 | 12/2016 | Strace | |
| 2018/0303258 | A1 | 10/2018 | Lin | |
| 2020/0305521 | A1 | 10/2020 | Elliot et al. | |
| 2021/0298392 | A1 | 9/2021 | Pearson | |
| 2023/0240393 | A1 | 8/2023 | Lebrun et al. | |
| 2024/0172848 | A1 | 5/2024 | Sankar | |

* cited by examiner

MULTI-USE ARTICLE

RELATED APPLICATIONS INFORMATION

This application is related to application Ser. No. 17/656,628, now U.S. Pat. No. 11,470,894. This application is related to co-pending application Ser. No. 18/305,337, which is a continuation of application Ser. No. 17/656,628. This application is a continuation of application Ser. No. 17/931,400, now U.S. Pat. No. 11,779,067.

FIELD OF THE INVENTION

The present invention relates to articles that can be configured for multiple uses. More particularly, the invention relates to items that can be converted from one configuration for a given use into other configurations for other uses. In some embodiments, an article can be converted into various configurations including a jacket, a carrying bag, a pillow, and/or a blanket.

BACKGROUND OF THE INVENTION

Often it is desirable to be able to convert an item configured for a certain to use into an item for a different use. Clothing that can be configured for use in multiple modalities is known.

The present application provides embodiments of articles that satisfy current needs for items convertible into jackets, carrying bags, pillows, and/or blankets.

SUMMARY OF THE INVENTION

This summary is provided to introduce a selection of concepts in a simplified format that are further described in the detailed description of the present disclosure. This summary is not intended to identify key or essential inventive concepts of the present disclosure, nor is it intended for determining the scope of the present disclosure.

In one aspect, the invention concerns a multi-purpose article having a first portion configured to cover the torso of a user; a second portion removably coupled to the first portion, the second portion configured to cover at least some part of the legs of the user; wherein the second portion, when removed from the first portion, is configured for use as a blanket, a carrying bag, or a pillow; and wherein the first portion is configured to be placed inside the second portion to form the pillow.

In some embodiments, the article includes handles coupled to the second portion to facilitate handling the carrying bag. In one embodiment, the first portion is a jacket. In certain embodiments, the jacket is a puffer jacket. In some embodiments, the first portion is a crop top puffer jacket.

In one embodiment, the article includes a first fastener configured to removably couple the first portion to the second portion. In some embodiments, the article further includes a second fastener placed along an edge of the second portion, the second fastener configured to close an opening of the second portion to provide a bottom of the carrying bag. In certain embodiments, the first fastener and the second fastener each is a zipper.

Another aspect of the invention is directed to a method of manufacturing a multi-purpose article. The method can include providing a puffer jacket top; providing a puffer skirt; wherein the puffer jacket top and the puffer skirt are configured to be removably coupled to one another; and wherein the puffer skirt is configured for use as a blanket, carrying bag, and pillow.

In one embodiment, method can include providing a puffer jacket top having a first zipper along a distal end of the puffer jacket top. In some embodiments, the method can include providing a puffer skirt having a zipper along a first distal end of the puffer skirt and anther zipper along a second distal end of the puffer skirt. In certain embodiments, the method can include providing a puffer skirt having a zipper along edges lateral to the first and second end (for example, fastener or zipper 122 shown in FIG. 3). In one embodiment, the method can include providing a puffer skirt having handles configured to facilitate transporting the carrying bag.

Yet another aspect of the invention concerns a jacket convertible into a blanket, carrying bag, and pillow. In one embodiment, the jacket can include a torso cover configured to cover at least from about the neck of a user to about at least the breast bone of the user; a leg cover configured to cover at least some part of the legs of the user; wherein the torso cover and the leg cover are configured to be removably coupled to one another; and wherein the leg cover is configured to function as a blanket, carrying bag, and pillow.

In some embodiments, the torso cover is configured to be worn as a crop top jacket after the torso cover is uncoupled from the leg cover. In certain embodiments, the torso cover is configured to be worn as a full-length jacket after the torso cover is uncoupled from the leg cover.

In one embodiment, the torso cover can include a first fastener along a torso cover distal end. In some embodiments, the leg cover includes a fastener along a first distal end of the leg cover and another fastener along a second distal end of the leg cover. In certain embodiments, the fasteners can each be a zipper.

In one embodiment the leg cover is configured to receive the torso cover to form the pillow. In some embodiments, the leg cover can include a fastener along a distal end of the leg cover, wherein a closing of the fastener provides a bottom of the carrying bag.

To further clarify the advantages and features of the present disclosure, a more particular description of the disclosure will be rendered by reference to specific embodiments thereof, which is illustrated in the appended drawings. It is appreciated that these drawings depict only typical embodiments of the disclosure and are therefore not to be considered limiting of its scope. The disclosure will be described and explained with additional specificity and detail with the accompanying drawings.

BRIEF DESCRIPTION OF THE DRAWINGS

The subject matter that is regarded as the invention is particularly pointed out and distinctly claimed in the claims at the conclusion of the specification. The foregoing and other aspects, features, and advantages of the invention are apparent from the following detailed description taken in conjunction with the accompanying drawings in which:

Figure 1:
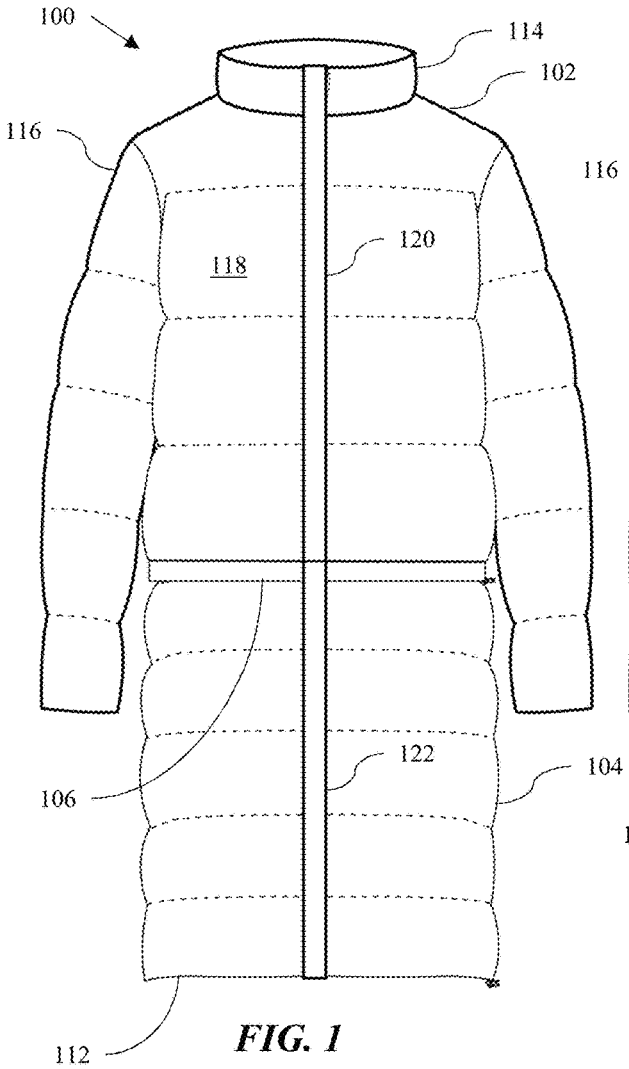
FIG. 1 is a front plan view of a multi-use article in accordance with some embodiments of the invention.

Further, skilled artisans will appreciate that elements in the drawings are illustrated for simplicity and may not have necessarily been drawn to scale. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having the benefit of the description herein.

DETAILED DESCRIPTION OF THE INVENTION

For the purpose of promoting an understanding of the principles of the invention, reference will now be made to the embodiment illustrated in the drawings, and specific language will be used to describe the same. It will nevertheless be understood that no limitation of the scope of the invention is thereby intended. Such alterations and further modifications in the illustrated system, and such further applications of the principles of the invention as illustrated therein would be contemplated as would normally occur to one skilled in the art to which the invention relates. Unless otherwise defined, all technical and scientific terms used herein have the same meaning as commonly understood by one of ordinary skilled in the art. The system, methods, and examples provided herein are illustrative only and are not intended to be limiting.

The term "some" as used herein is to be understood as "none or one or more than one or all." Accordingly, the terms "none," "one," "more than one," "more than one, but not all" or "all" would all fall under the definition of "some." The term "some embodiments" may refer to no embodiments or to one embodiment or to several embodiments or to all embodiments, without departing from the scope of the present disclosure.

The terminology and structure employed herein is for describing, teaching, and illuminating some embodiments and their specific features. It does not in any way limit, restrict or reduce the spirit and scope of the claims or their equivalents.

More specifically, any terms used herein such as but not limited to "includes," "comprises," "has," "consists," and grammatical variants thereof do not specify an exact limitation or restriction and certainly do not exclude the possible addition of one or more features or elements, unless otherwise stated, and furthermore must not be taken to exclude the possible removal of one or more of the listed features and elements, unless otherwise stated with the limiting language "must comprise" or "needs to include."

Whether or not a certain feature or element was limited to being used only once, either way, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language such as "there needs to be one or more . . . " or "one or more element is required."

Unless otherwise defined, all terms, and especially any technical and/or scientific terms, used herein may be taken to have the same meaning as commonly understood by one having ordinary skills in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility and non-obviousness.

Use of the phrases and/or terms including, but not limited to, "a first embodiment," "a further embodiment," "an alternate embodiment," "one embodiment," "an embodiment," "multiple embodiments," "some embodiments," "other embodiments," "further embodiment", "furthermore embodiment", "additional embodiment" or variants thereof do not necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or alternatively in the context of more than one embodiment, or further alternatively in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should not be necessarily taken as limiting factors to the attached claims. The attached claims and their legal equivalents can be realized in the context of embodiments other than the ones used as illustrative examples in the description below. Embodiments of the present invention will be described below in detail with reference to the accompanying drawings.

Figure 2:
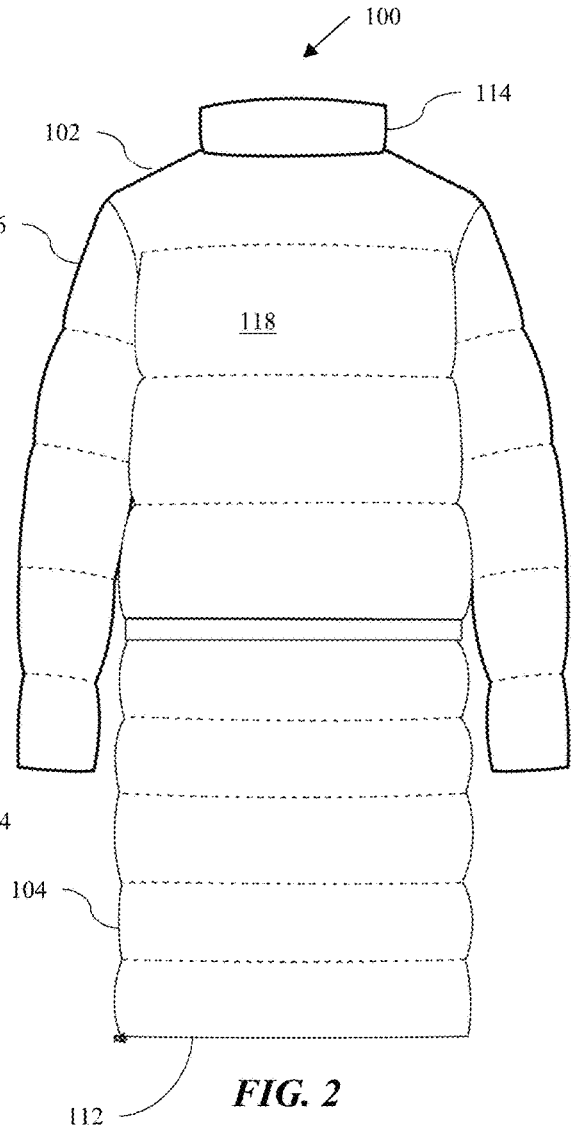
FIG. 2 is a back plan view of the multi-use article of FIG. 1.

Referencing FIG. 1 and FIG. 2, in one embodiment article 100 includes first portion 102 and second portion 104. In some embodiments, first portion 102 is configured to cover at least part of the torso of a user. In certain embodiments, second portion 104 is configured to cover at least part of the legs of a user. In one embodiment, first portion 102 can be, for example, a jacket (which jacket can be, for example, a puffer jacket). In certain embodiments, first portion 102 can be configured as a crop top jacket, for example. In some embodiments, second portion 104 can be, for example, a skirt-like item configured to releasably couple to first portion 102.

Figure 5:
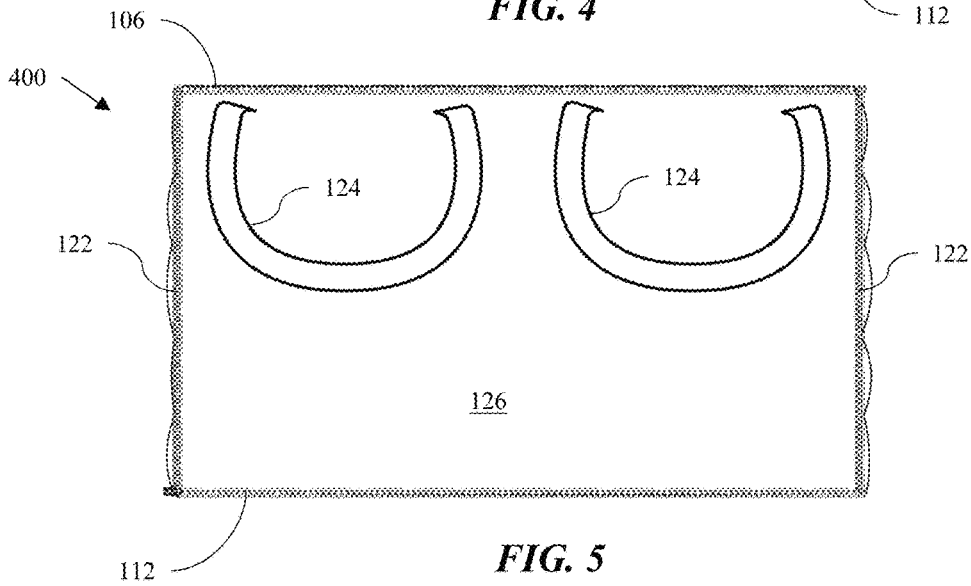
FIG. 5 is a plan back view of the blanket of FIG. 4.

In one embodiment, first portion 102 can include neck collar 114 and sleeves 116 suitably coupled to torso cover 118. In some embodiments, first portion 102 can include torso fastener 120 configured to close torso cover 118. In certain embodiments, torso fastener 120 can be a zipper that extends from about neck collar 114 to a distal end (bottom edge) of first portion 102. In one embodiment, second portion 104 can include leg cover fastener 122 configured to close an opening of second portion 104 and to couple two distal, axial ends of second portion 104. In some embodiments, leg cover fastener 122 can be placed along axial edges of second portion 104, running from about fastener 106 to about bag fastener 112 (FIG. 5). Article 100 can be made of any suitable materials including cotton, leather, synthetic leather, nylon, fleece, synthetic materials, polyester, rayon, spandex, lace, and the like.

Figure 3:
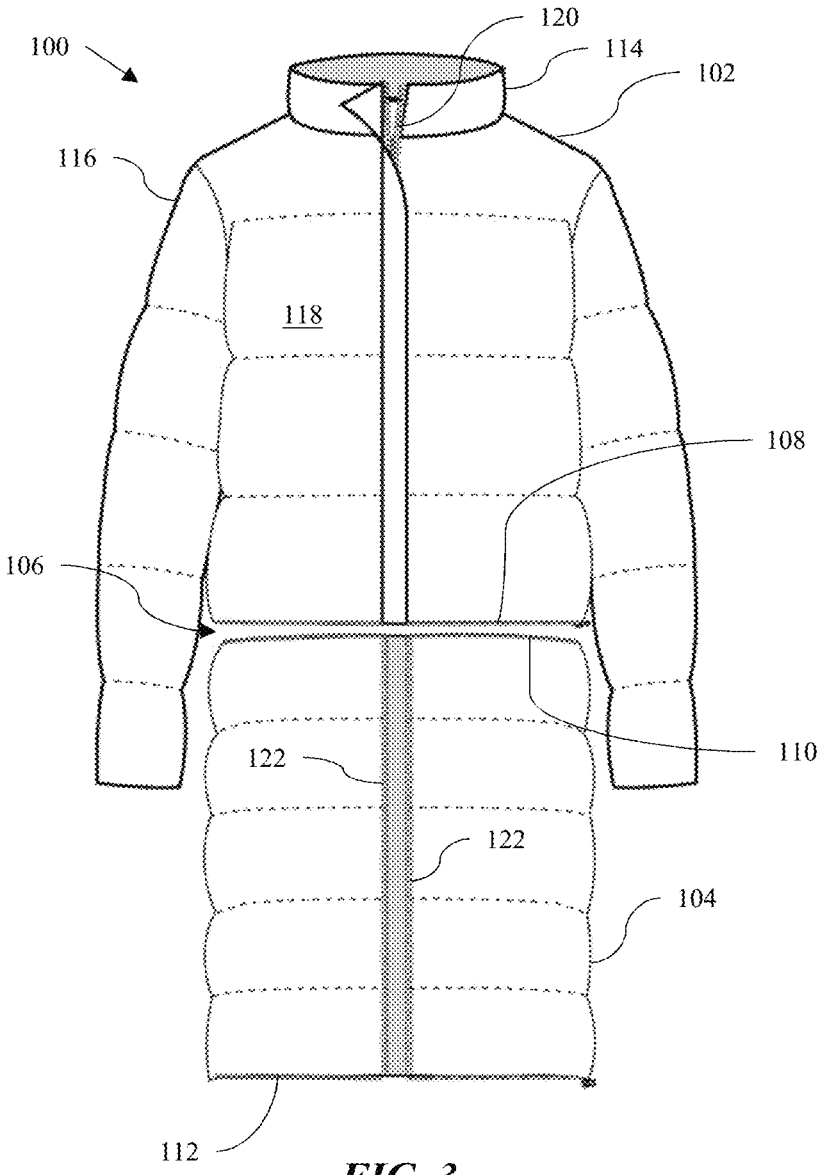
FIG. 3 is a front plan view of the multi-use article of FIG. 1 in one configuration in accordance with some embodiments of the invention.

Referencing FIG. 3, in one embodiment, article 100 can include fastener 106 configured to facilitate releasably coupling first portion 102 to second portion 104. In some embodiments, fastener 106 can include, for example, first zipper part 108 placed along a distal end (bottom edge) of first portion 102, and fastener 106 can further include second zipper part 110 placed along a distal end (top edge) of second portion 104. In certain embodiments, second portion 104 can include bag fastener 112 along a distal end (bottom edge) of second portion 104. Bag fastener 112 can be configured to close an opening of second portion 104, which closing results in the forming of bag bottom 602 of carrying bag 600 (FIG. 6).

Figure 4:
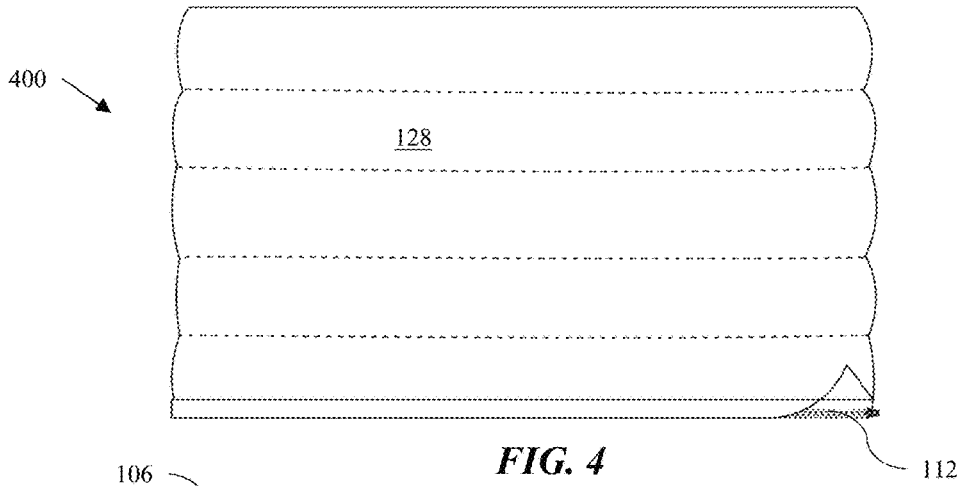
FIG. 4 is a plan front view of a blanket configuration of a certain portion of the multi-use article of FIG. 1 in accordance with some embodiments of the invention.

Referencing FIG. 3 through FIG. 10, in one embodiment first portion 102 and second portion 104 can be separated by releasing fastener 106 (FIG. 3). In some embodiments, when first portion 102 is released from second portion 104, first portion 102 can be used as a standalone torso cover (such as a jacket or a crop jacket, for example). Second portion 104, when released from first portion 102, can be configured as blanket 400 (FIG. 4, FIG. 5). Preferably, the size and other design factors of second portion 104 are suitably selected so that second portion 104 can be generally used as a blanket (for example, to cover a person or for sitting upon).

In certain embodiments, second portion 104 can include handles 124 configured to facilitate transporting carrying bag 600. In one embodiment, handles 124 are placed on inner surface 126 of second portion 104, for example. Inner surface 126 is a surface opposite outer surface 128 of second portion 104.

Figure 6:
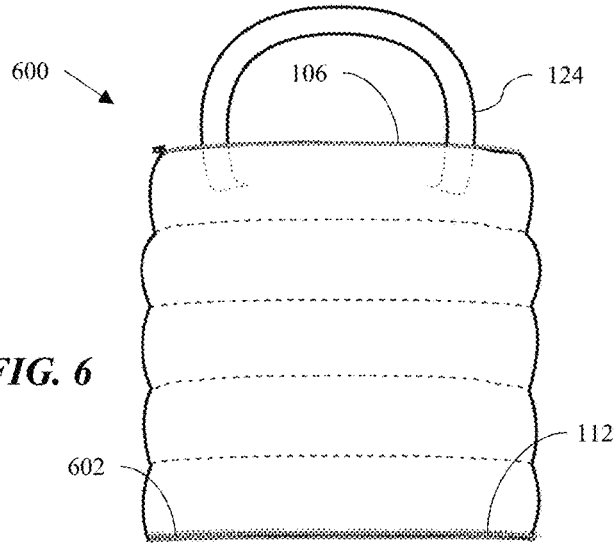
FIG. 6 is a plan back view of a carrying bag configuration of a certain portion of the multi-use article of FIG. 1 in accordance with some embodiments of the invention.
Figure 7:
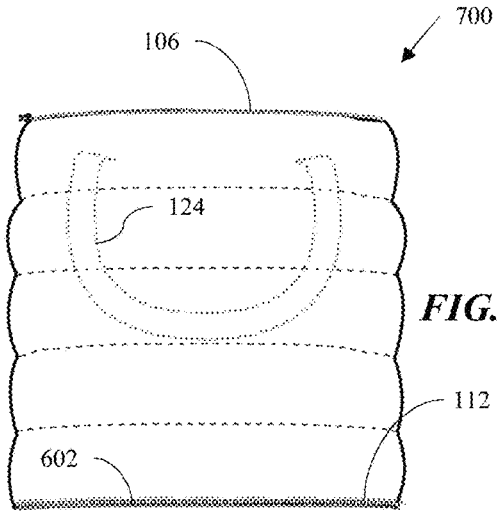
FIG. 7 is a plan back view of a pillow configuration of a certain portion of the multi-use article of FIG. 1 in accordance with some embodiments of the invention.

In some embodiments, second portion 104 can be configured as carrying bag 600 (FIG. 6). In this configuration, leg cover fastener 122 is closed (not shown in FIG. 6) and bag fastener 112 is closed. Closing fastener 112 provides bag bottom 602. Handles 124 can be pulled out from inner surface 126 to facilitate transporting bag 600.

Figure 8:
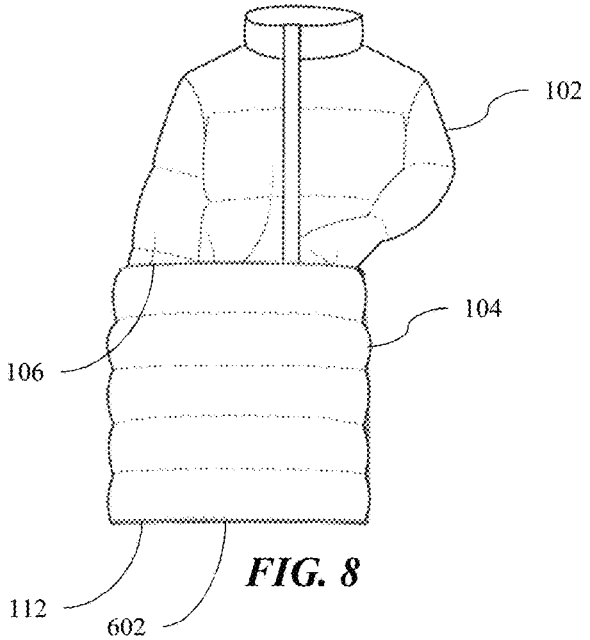
FIG. 8 is an illustration of a jacket portion being inserted into a skirt portion to form a pillow according to one embodiment of the invention.
Figure 9:
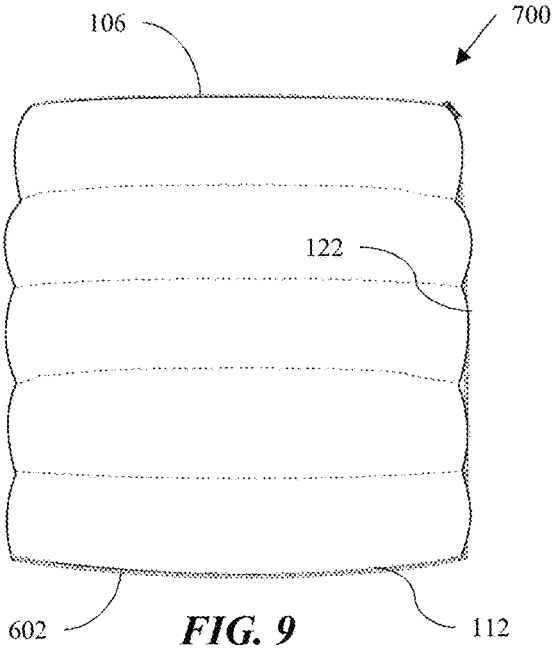
FIG. 9 is a plan top view of a pillow configuration formed from the multi-use article of FIG. 1.
Figure 10:
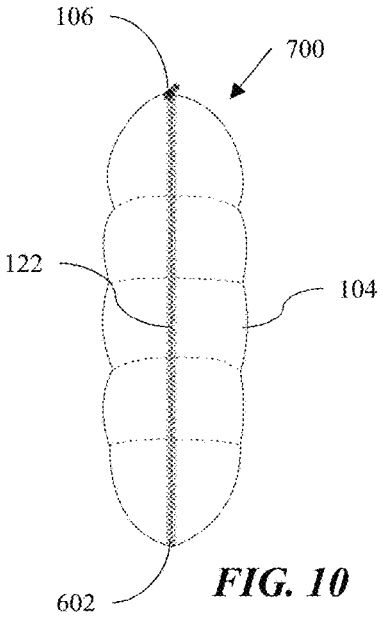
FIG. 10 is a plan side view of the pillow of FIG. 9.

In certain embodiments, second portion 104 can be configured as pillow 700 (FIG. 7 through FIG. 10). In this configuration, leg cover fastener 122 is closed (not shown in FIG. 7), fastener 106 is closed, and bag fastener 112 is closed. Closing fastener 112 provides a pillow or pillow case. Handles 124 can be left inside second portion 104. In some embodiments, second portion 104 is part of a puffer jacket (or made with puffer material); in such embodiments, second portion 104 can be suitable as a pillow by itself. In some embodiments, second portion 104 can be used as a pillow case configured to receive first portion 102; in such embodiments, first portion 102 acts as a filler material that cooperates with second portion 104 to form pillow 700 (FIG. 8). In certain embodiments, first portion 102 is a puffer jacket that suitably provides a soft, plushy pillow when used with second portion 104 as pillow 700.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all the acts necessarily need to be performed. Also, those acts that are not dependent on other acts may be performed in parallel with the other acts. The scope of the embodiments is by no means limited by these specific examples. Numerous variations, whether explicitly given in the specification or not, such as differences in structure, dimension, and use of material, are possible.

The invention claimed is:

1. A multi-purpose article comprising:

a torso cover having a front-opening zipper;

a leg cover removably coupled to the torso cover;

wherein the leg cover comprises a first zipper configured to align with said front-opening zipper such that the torso cover and the leg cover, when coupled, form a jacket;

wherein the leg cover comprises a second zipper coupled to a bottom edge of the leg cover, the second zipper configured to fully close said bottom edge; and wherein the leg cover, when removed from the torso cover, is configured for use as a carrying bag by closing the second zipper.

2. The multi-purpose article of claim 1, further comprising a first fastener coupled to the torso cover and a second fastener coupled to the leg cover along a first edge of the leg cover, and wherein the first fastener and the second fastener are configured to facilitate removably coupling the torso cover to the leg cover.

3. The multi-purpose article of claim 2, wherein the first fastener comprises a first zipper, wherein the second fastener comprises a second zipper.

4. The multi-purpose article of claim 2, further comprising a third fastener placed along a second edge of the leg cover, wherein the third fastener is configured to close a first opening of the leg cover, and wherein leg cover is configured to receive the torso cover to facilitate converting the leg cover into a pillow.

5. A method of manufacturing a multi-purpose article, the method comprising:

providing a torso cover having a front opening and a bottom edge;

coupling a front-opening zipper to said front opening;

coupling a first zipper part to said bottom edge;

providing a leg cover having first, second, third, and fourth edges;

coupling a second zipper part to said first edge such that the torso cover and the leg cover are configured to be removably coupled to one another by zipping or unzipping the first zipper part with the second zipper part;

coupling a third zipper part to said second edge;

coupling a fourth zipper part to said third edge;

wherein the third zipper part and fourth zipper part align with the front-opening zipper such that when the torso cover and the leg cover are coupled the torso cover and the leg cover form a jacket;

coupling a fifth zipper to said fourth edge;

wherein the leg cover is configured for use as a blanket by unzipping the first, second, third, fourth, and fifth zippers; and wherein the leg cover is configured for use as a carrying bag or a pillow by zipping the second, third, fourth, and fifth zippers.

6. The method of claim 5, the leg cover comprises handles configured to facilitate transporting the carrying bag.

7. A multi-part jacket convertible into a blanket, carrying bag and pillow, the multi-part jacket comprising:

a first portion comprising a jacket;

a second portion comprising a leg cover, wherein the second portion is configured to couple to the first portion such that when the first portion and the second portion are coupled they form an elongated jacket;

wherein the jacket and the leg cover are configured to be removably coupled to one another; and wherein the second portion is configured to function, alternatively, as a carrying bag or a pillow.

8. The multi-part jacket of claim 7, wherein the second portion is configured to receive the first portion to form a pillow.

9. The multi-part jacket of claim 7, wherein the leg cover comprises a fastener along a distal end of the leg cover, and wherein a closing of the fastener provides a bottom of the carrying bag and facilitates converting the leg cover into a carrying bag.

* * * * *